US005992548A

United States Patent [19]

Silva et al.

[11] Patent Number: 5,992,548

[45] Date of Patent: Nov. 30, 1999

[54] BI-CENTER BIT WITH OPPOSITELY DISPOSED CUTTING SURFACES

[75] Inventors: Roger Silva; Brad Weston, both of Houston; Henry Rebollido, Sugar Land; Coy M. Fielder, Cypress, all of Tex.

[73] Assignee: Diamond Products International, Inc., Houston, Tex.

[21] Appl. No.: 08/955,147

[22] Filed: Oct. 21, 1997

Related U.S. Application Data

[63] Continuation-in-part of application No. 08/515,536, Aug. 15, 1995, Pat. No. 5,678,644.

[51] Int. Cl.[6] ..... E21B 10/26; E21B 10/56

[52] U.S. Cl. ..... 175/391; 175/385; 175/399

[58] Field of Search ..... 175/385, 391, 175/398, 399, 408

[56] References Cited

U.S. PATENT DOCUMENTS

| | | | |
|---|---|---|---|
| 3,848,683 | 11/1974 | Persson | 175/258 X |
| 3,851,719 | 12/1974 | Thompson et al. . | |
| 3,945,447 | 3/1976 | Peterson . | |
| 4,243,112 | 1/1981 | Sartor | 175/329 X |
| 4,408,669 | 10/1983 | Wiredal | 175/258 |
| 4,440,244 | 4/1984 | Wiredal . | |
| 4,770,259 | 9/1988 | Jansson | 175/398 X |
| 4,815,342 | 3/1989 | Brett et al. . | |
| 5,009,271 | 4/1991 | Maric et al. | 175/398 X |
| 5,010,789 | 4/1991 | Brett et al. . | |
| 5,040,621 | 8/1991 | Lof . | |
| 5,042,596 | 8/1991 | Brett et al. . | |
| 5,052,503 | 10/1991 | Lof . | |
| 5,111,892 | 5/1992 | Sinor et al. . | |
| 5,131,478 | 7/1992 | Brett et al. . | |
| 5,186,268 | 2/1993 | Clegg . | |
| 5,379,854 | 1/1995 | Dennis . | |
| 5,423,389 | 6/1995 | Warren et al. . | |
| 5,497,842 | 3/1996 | Pastusek et al. . | |
| 5,558,170 | 9/1996 | Thigpen et al. | 175/57 |
| 5,765,653 | 6/1998 | Doster et al. . | |
| 5,873,422 | 2/1999 | Hansen et al. | 175/399 |

FOREIGN PATENT DOCUMENTS

| | | |
|---|---|---|
| 0605151A1 | 7/1994 | European Pat. Off. . |
| 2648862 | 6/1989 | France . |

*Primary Examiner*—David J Bagnell
*Assistant Examiner*—Jong-Suk Lee
*Attorney, Agent, or Firm*—Sankey & Luck, L.L.P.

[57] ABSTRACT

An improved bi-center bit with improved directional stability and wear resistance is disclosed, which bit optimally utilizing a plurality of shaped PDC cutting elements selectively situated about the cutting surfaces of the pilot and the reamer to produce a minimal force imbalance, where further the pilot bit and the reamer are force balanced to further reduce imbalance in the operation of the tool.

21 Claims, 14 Drawing Sheets

| CUT NO. | CUTTER RADIUS ( IN. ) | BACK RAKE ( DEG. ) | SIDE RAKE ( DEG. ) | PROF. ANGLE ( DEG. ) | LONG. POS. ( IN. ) | ANG. POS. ( DEG. ) | PDC WAFER ( IN. ) | TRIM FLAG |
|---|---|---|---|---|---|---|---|---|
| 1 | 0.2449 | 15.000 | 0.000 | -20.00 | 0.0709 | 0.00 | 0.2646 | 1 |
| 2 | 0.6520 | 15.000 | 0.000 | -20.00 | 0.2189 | 180.00 | 0.2646 | 1 |
| 3 | 1.0150 | 15.000 | 0.000 | -20.00 | 0.3512 | 0.00 | 0.2646 | 1 |
| 4 | 1.3331 | 15.000 | 0.000 | -20.00 | 0.4661 | 180.00 | 0.2646 | 1 |
| 5 | 1.6220 | 15.000 | 0.000 | -14.00 | 0.5661 | 0.00 | 0.2646 | 1 |
| 6 | 1.8480 | 15.000 | 0.000 | -1.00 | 0.5941 | 305.00 | 0.2646 | 1 |
| 7 | 2.0020 | 15.000 | 0.000 | 8.00 | 0.5839 | 65.00 | 0.2646 | 1 |
| 8 | 2.1480 | 15.000 | 0.000 | 17.00 | 0.5520 | 180.00 | 0.2646 | 1 |
| 9 | 2.2740 | 15.000 | 0.000 | 24.00 | 0.5039 | 0.00 | 0.2646 | 1 |
| 10 | 2.3909 | 15.000 | 0.000 | 32.00 | 0.4409 | 125.00 | 0.2646 | 1 |
| 11 | 2.4811 | 15.000 | 0.000 | 38.00 | 0.3780 | 305.00 | 0.2646 | 1 |
| 12 | 2.5882 | 15.000 | 0.000 | 47.00 | 0.2791 | 65.00 | 0.2646 | 1 |
| 13 | 2.6598 | 15.000 | 0.000 | 53.00 | 0.1941 | 245.00 | 0.2646 | 1 |
| 14 | 2.7429 | 15.000 | 0.000 | 62.00 | 0.0630 | 180.00 | 0.2646 | 1 |
| 15 | 2.8051 | 15.000 | 0.000 | 71.00 | -0.0799 | 0.00 | 0.2646 | 1 |
| 16 | 2.8520 | 15.000 | 0.000 | 83.00 | -0.2831 | 125.00 | 0.2646 | 1 |
| 17 | 2.8591 | 15.000 | 0.000 | 90.00 | -0.4059 | 305.00 | 0.2646 | 1 |
| 18 | 2.8850 | 30.000 | 0.000 | 90.00 | -0.9969 | 245.00 | 0.2646 | 1 |
| 19 | 2.8850 | 30.000 | 0.000 | 90.00 | -0.9969 | 180.00 | 0.2646 | 1 |
| 20 | 2.8850 | 30.000 | 0.000 | 90.00 | -0.9969 | 0.00 | 0.2646 | 1 |
| 21 | 2.8850 | 30.000 | 0.000 | 90.00 | -0.9969 | 125.00 | 0.2646 | 1 |
| 22 | 2.8850 | 30.000 | 0.000 | 90.00 | -0.9969 | 305.00 | 0.2646 | 1 |

FIG. 11

| CUT NO. | CUTTER RADIUS ( IN. ) | BACK RAKE ( DEG. ) | SIDE RAKE ( DEG. ) | PROF. ANGLE ( DEG. ) | LONG. POS. ( IN. ) | ANG. POS. ( DEG. ) | PDC WAFER ( IN. ) | TRIM FLAG |
|---|---|---|---|---|---|---|---|---|
| 1 | 0.2449 | 15.000 | 0.000 | -20.00 | 0.0709 | 205.00 | 0.2646 | 1 |
| 2 | 0.6520 | 15.000 | 0.000 | -20.00 | 0.2189 | 25.00 | 0.2646 | 1 |
| 3 | 1.0150 | 15.000 | 0.000 | -20.00 | 0.3512 | 205.00 | 0.2646 | 1 |
| 4 | 1.3331 | 15.000 | 0.000 | -20.00 | 0.4661 | 25.00 | 0.2646 | 1 |
| 5 | 1.6220 | 15.000 | 0.000 | -14.00 | 0.5661 | 205.00 | 0.2646 | 1 |
| 6 | 1.8480 | 15.000 | 0.000 | -1.00 | 0.5941 | 155.00 | 0.2646 | 1 |
| 7 | 2.0020 | 15.000 | 0.000 | 8.00 | 0.5839 | 270.00 | 0.2646 | 1 |
| 8 | 2.1480 | 15.000 | 0.000 | 17.00 | 0.5520 | 25.00 | 0.2646 | 1 |
| 9 | 2.2740 | 15.000 | 0.000 | 24.00 | 0.5039 | 205.00 | 0.2646 | 1 |
| 10 | 2.3909 | 15.000 | 0.000 | 32.00 | 0.4409 | 330.00 | 0.2646 | 1 |
| 11 | 2.4811 | 15.000 | 0.000 | 38.00 | 0.3780 | 155.00 | 0.2646 | 1 |
| 12 | 2.5882 | 15.000 | 0.000 | 47.00 | 0.2791 | 270.00 | 0.2646 | 1 |
| 13 | 2.6598 | 15.000 | 0.000 | 53.00 | 0.1941 | 245.00 | 0.2646 | 1 |
| 14 | 2.7429 | 15.000 | 0.000 | 62.00 | 0.0630 | 25.00 | 0.2646 | 1 |
| 15 | 2.8051 | 15.000 | 0.000 | 71.00 | -0.0799 | 205.00 | 0.2646 | 1 |
| 16 | 2.8520 | 15.000 | 0.000 | 83.00 | -0.2831 | 330.00 | 0.2646 | 1 |
| 17 | 2.8591 | 15.000 | 0.000 | 90.00 | -0.4059 | 155.00 | 0.2646 | 1 |
| 18 | 2.8850 | 30.000 | 0.000 | 90.00 | -0.9969 | 245.00 | 0.2646 | 1 |
| 19 | 2.8850 | 30.000 | 0.000 | 90.00 | -0.9969 | 25.00 | 0.2646 | 1 |
| 20 | 2.8850 | 30.000 | 0.000 | 90.00 | -0.9969 | 205.00 | 0.2646 | 1 |
| 21 | 2.8850 | 30.000 | 0.000 | 90.00 | -0.9969 | 330.00 | 0.2646 | 1 |
| 22 | 2.8850 | 30.000 | 0.000 | 90.00 | -0.9969 | 155.00 | 0.2646 | 1 |
| 23 | 3.0563 | 15.000 | 0.000 | 27.00 | -1.7720 | 30.00 | 0.2646 | 1 |

FIG. 12A

| CUT NO. | CUTTER RADIUS ( IN. ) | BACK RAKE ( DEG. ) | SIDE RAKE ( DEG. ) | PROF. ANGLE ( DEG. ) | LONG. POS. ( IN. ) | ANG. POS. ( DEG. ) | PDC WAFER ( IN. ) | TRIM FLAG |
|---|---|---|---|---|---|---|---|---|
| 24 | 3.0563 | 15.000 | 0.000 | 27.00 | -1.7720 | 90.00 | 0.2646 | 1 |
| 25 | 3.3193 | 15.000 | 0.000 | 34.00 | -1.9272 | 0.00 | 0.2646 | 1 |
| 26 | 3.3193 | 15.000 | 0.000 | 34.00 | -1.9272 | 60.00 | 0.2646 | 1 |
| 27 | 3.5626 | 15.000 | 0.000 | 41.00 | -2.1130 | 30.00 | 0.2646 | 1 |
| 28 | 3.5626 | 15.000 | 0.000 | 41.00 | -2.1130 | 90.00 | 0.2646 | 1 |
| 29 | 3.7795 | 15.000 | 0.000 | 48.00 | -2.3272 | 0.00 | 0.2646 | 1 |
| 30 | 3.7795 | 15.000 | 0.000 | 48.00 | -2.3272 | 60.00 | 0.2646 | 1 |
| 31 | 3.9693 | 15.000 | 0.000 | 55.00 | -2.5661 | 30.00 | 0.2646 | 1 |
| 32 | 3.9693 | 15.000 | 0.000 | 55.00 | -2.5661 | 90.00 | 0.2646 | 1 |
| 33 | 4.1295 | 15.000 | 0.000 | 62.00 | -2.8260 | 0.00 | 0.2646 | 1 |
| 34 | 4.1295 | 15.000 | 0.000 | 62.00 | -2.8260 | 60.00 | 0.2646 | 1 |
| 35 | 4.2555 | 15.000 | 0.000 | 69.00 | -3.1039 | 30.00 | 0.2646 | 1 |
| 36 | 4.2555 | 15.000 | 0.000 | 69.00 | -3.1039 | 90.00 | 0.2646 | 1 |
| 37 | 4.3472 | 15.000 | 0.000 | 76.00 | -3.3949 | 0.00 | 0.2646 | 1 |
| 38 | 4.3472 | 15.000 | 0.000 | 76.00 | -3.3949 | 60.00 | 0.2646 | 1 |
| 39 | 4.4035 | 15.000 | 0.000 | 83.00 | -3.6949 | 30.00 | 0.2646 | 1 |
| 40 | 4.4035 | 15.000 | 0.000 | 83.00 | -3.6949 | 90.00 | 0.2646 | 1 |
| 41 | 4.4224 | 15.000 | 0.000 | 90.00 | -4.0000 | 0.00 | 0.2646 | 1 |
| 42 | 4.4224 | 15.000 | 0.000 | 90.00 | -4.0000 | 60.00 | 0.2646 | 1 |
| 43 | 4.4480 | 30.000 | 0.000 | 90.00 | -4.6484 | 30.00 | 0.2646 | 1 |
| 44 | 4.4480 | 30.000 | 0.000 | 90.00 | -4.6484 | 90.00 | 0.2646 | 1 |
| 45 | 4.4480 | 30.000 | 0.000 | 90.00 | -4.6484 | 0.00 | 0.2646 | 1 |
| 46 | 4.4480 | 30.000 | 0.000 | 90.00 | -4.6484 | 60.00 | 0.2646 | 1 |

FIG. 12B

FIG. 16
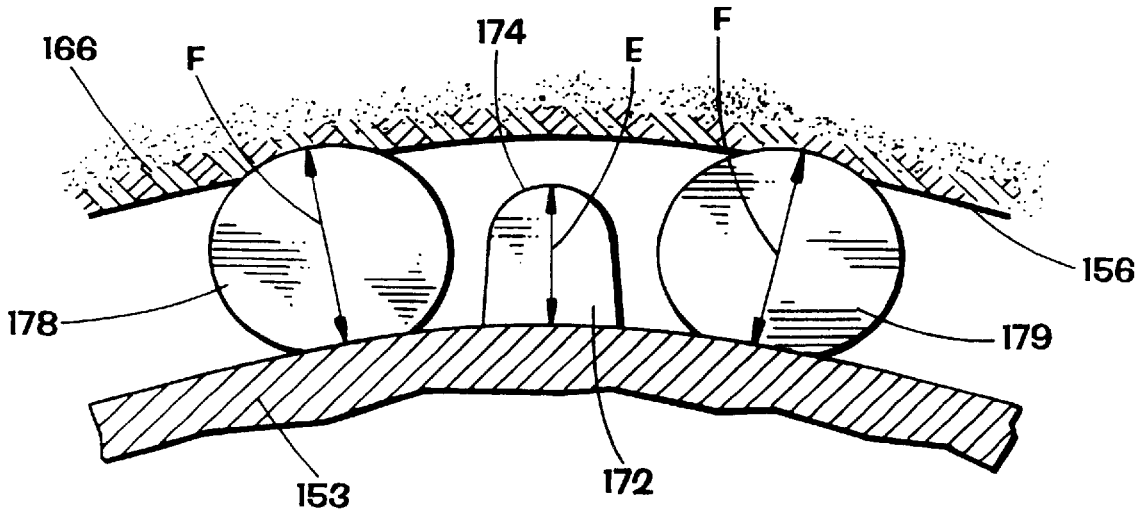
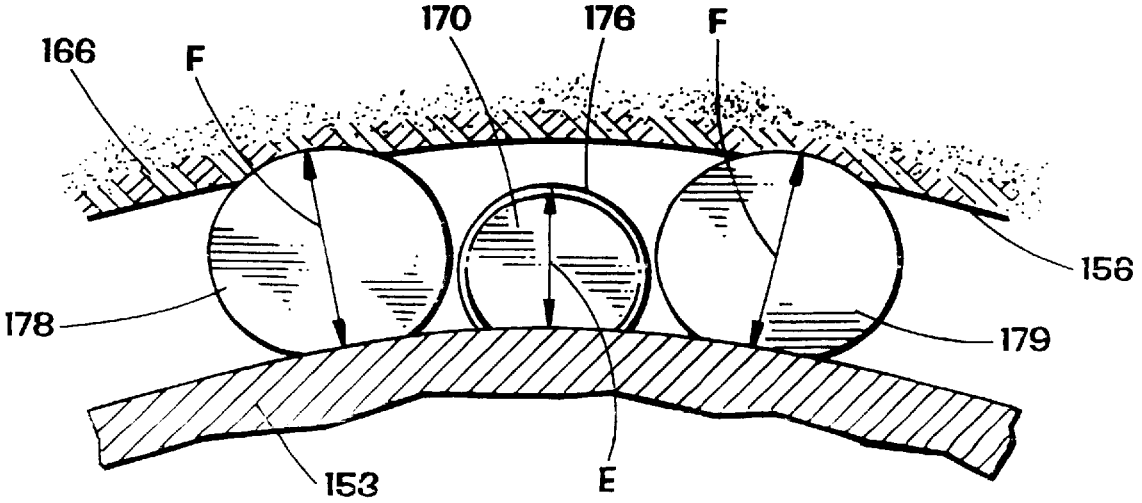
FIG. 17

BI-CENTER BIT WITH OPPOSITELY DISPOSED CUTTING SURFACES

CROSS REFERENCE TO RELATED APPLICATIONS

This application is a continuation-in-part of applicants' application, Ser. No. 08/515,536, as filed on Aug. 15, 1995, now U.S. Pat. No. 5,678,644 the disclosure of which is incorporated herein.

BACKGROUND OF THE INVENTION

1. Field of the Invention

The present invention generally relates to drill bits useful for drilling oil, gas and water wells and methods for manufacturing such bits. More specifically, the present invention relates to a stabilized bi-center bit incorporating shaped polycrystalline diamond compacts which are selectively positioned about the cutting surface of either or both of the pilot and the reamer, and/or a redesign of the pilot vis-a-vis the reamer to optimize force balancing.

2. Description of the Prior Art

A significant source of many drilling problems relates to drill bit and string instability, of which there are many types. Bit and/or string instability probably occurs much more often than is readily apparent by reference to immediately noticeable problems. However, when such instability is severe, it places high stress on drilling equipment that includes not only drill bits but also downhole tools and the drill string in general. Common problems caused by such instability may include, but are not limited to, excessive torque, directional drilling control problems, and coring problems.

One typical approach to solving these problems is to over-design the drilling product to thereby resist the stress. However, this solution is usually expensive and can actually limit performance in some ways. For instance, one presently commercially available drill bit includes reinforced polycrystalline diamond compact ("PDC") members that are strengthened by use of a fairly large taper, or frustoconical contour on the PDC member. The taper angle is smaller than the backrake angle of the cutter to allow the cutter to cut into the formation at a desired angle. While this design makes the PDC cutters stronger so as to reduce cutter damage, it does not solve the primary problem of bit instability. Thus, drill string problems, directional drilling control problems, and excessive torque problems remain. Also, because the PDC diamond table must be ground on all of the PDC cutters, the drill bits made in this manner are more expensive and less resistant to abrasive wear as compared to the same drill bit made with standard cutters.

Another prior art solution to bit instability problems is directed toward a specific type of bit instability that is generally referred to as bit whirl. Bit whirl is a very complicated process that includes many types of bit movement patterns or modes of motion wherein the bit typically does not remain centered within the borehole. The solution is based on the premise that it is impossible to design and build a perfectly balanced bit. Therefore, an intentionally imbalanced bit is provided in a manner that improves bit stability. One drawback to this method is that for it to work, the bit forces must be the dominant force acting on the bit. The bits are generally designed to provide for a cutting force imbalance that may range about 500 to 2000 pounds depending on bit size and type. Unfortunately, there are many cases where gravity or string movements create forces larger than the designed cutting force imbalance and therefore become the dominant bit forces. In such cases, the intentionally designed imbalance is ineffective to prevent the bit from becoming unstable and whirling.

Yet another attempt to reduce bit instability requires devices that are generally referred to as penetration limiters. Penetration limiters work to prevent excessive cutter penetration into the formation that can lead to bit whirl or cutter damage. These devices may act to prevent not only bit whirl but also prevent radial bit movement or tilting problems that occur when drilling forces are not balanced.

As discussed in more depth hereinafter, penetration limiters should preferably satisfy two conditions. Conventional wisdom dictates that when the bit is drilling smoothly (i.e., no excessive forces on the cutters), the penetration limiters must not be in contact with the formation. Second, if excessive loads do occur either on the entire bit or to a specific area of the bit, the penetration limiters must contact the formation and prevent the surrounding cutters from penetrating too deeply into the formation.

Prior art penetration limiters are positioned behind the bit to perform this function. The prior art penetration limiters fail to function efficiently, either partially or completely, in at least some circumstances. Once the bit becomes worn such that the PDC cutters develop a wear flat, the prior art penetration limiters become inefficient because they begin to continuously contact the formation even when the bit is drilling smoothly. In fact, a bit with worn cutters does not actually need a penetration limiter because the wear flats act to maintain stability. An ideal penetration limiter would work properly when the cutters are sharp but then disappear once the cutters are worn.

Another shortfall of prior art penetration limiters is that they cannot function of the bit is rocked forward, as may occur in some types of bit whirling or tilting. The rear positioning of prior art penetration limiters results in their being lifted so far from the formation during bit tilting that they become ineffective. Thus, to be most effective, the ideal penetration limiter would be in line with the cutters rather than behind or in front. However, this positioning takes space that is used for the cutters.

While the above background has been directed to drill bits in general, more specific problems of bit instability are created in the instance of the bi-center bit. Bi-center bits have been used sporadically for over two decades as an alternative to undereaming. A desirable aspect to the bi-center bit is its ability to pass through a small hole and then drill a hole of a greater diameter. Problems associated with the bi-center bit, however, include those of a short life due to irregular wear patterns and excessive wear, the creation of a smaller than expected hole size and overall poor directional characteristics.

As in the instance of conventional drill bits, many solutions have been proposed to overcome the above disadvantages associated with instability and wear. For example, the use of penetration limiters has also been employed to enhance the stability of the bi-center bit. However, the prior art has not addressed the difficulties associated with the placement of such penetration limiters to properly stabilize the bi-center bit, which by its design, is inherently unstable. Penetration limiters in more traditional applications have been simply placed behind multiple cutters on each blade and only the exposure of the cutters above the height of the penetration limiter was felt critical to producing proper penetration limiter qualities. Additional considerations, however, are involved with the placement of shaped cutters on a bi-center bit which must contemplate the cutting force of both the reamer and the pilot bit.

As a result of these and other proposed problems, the bi-center bit has yet to realize its potential as a reliable alternative to undereaming.

SUMMARY OF THE INVENTION

The present invention addresses the above identified and other disadvantages usually associated with the instability and poor wear characteristics associated with drill bits and more particularly bi-center bits.

The present invention generally comprises a pilot bit having a hard metal body defining a proximal end adapted to be operably coupled to the drill string, and an end face provided with a plurality of cutting elements, and a reamer section integrally formed on one side of the body between the proximal end and the end face. The resulting bi-center bit is adapted to be rotated in the borehole in a generally conventional fashion to create a hole of a larger diameter than through which it was introduced.

In accordance with the present invention, both the pilot bit and the reamer bit may be provided with a plurality of PDC cutter assemblies about the cutting surface of their end faces. The PDC cutter assemblies include at least one PDC assembly that is axially and laterally spaced from a central region. In a preferred embodiment of the invention, a first metal body is disposed adjacent to at least one final PDC cutter and includes a first sliding surface profiled to extend outwardly from a substantially continuous contact with the borehole wall rather than cutting into the borehole wall. A second metal body or penetration limiter is disposed radially outwardly and includes a second sliding surface profiled to extend outwardly a distance less than the adjacent PDC cutter and is operable to engage the formation when the neighboring PDC cutter cuts too deeply into the formation for substantially sliding rather than cutting engagement with the formation.

The metal body preferably contacts the borehole wall just forward, with respect to the drilling rotation direction, of a final PDC cutter assembly. The second metal body or penetration limiter is preferably provided with a PDC member. The second metal body extends outwardly a distance toward the formation greater than the PDC member, at least with a new bit.

The present invention contemplates that the bi-center bit may be stabilized by a number of techniques which may be utilized collectively or independently. One such embodiment includes the selective positioning of cutter assemblies about the cutting face of the bit. In this embodiment, shaped PDC assemblies are positioned about the leading edge of the reamer to act as a penetration limiter. Alternatively, the cutting angle of standard cutters on the reamer may be reduced to diminish the depth of cut of the reamer. Alternatively or additionally, a cutting force calculation is then performed for both the pilot and the reamer to arrive at an angular position for the cutter assemblies on the pilot. Modification to this positioning is then undertaken to minimize the differences in the cutting force magnitude between the pilot bit and the reamer. The relative position of the pilot and the reamer is then adjusted to minimize the force imbalance between the pilot and the reamer. Shaped PDC assemblies are then positioned about the cutting surfaces of the pilot along and proximate to the direction of the resultant force so as to maintain rotation about the centerline.

In an alternate embodiment, a first upset is situated some 180° degrees from the centerline defined by the reamer, where said upset is provided with first metal bodies to maintain rotation of the bit about the centerline. In yet another embodiment, a second upset is positioned some 180 degrees opposite the first upset and also provided with first metal bodies.

The present invention has a number of advantages over the prior art. One such advantage is enhanced stability in the borehole during a variety of operating conditions. Another advantage is improved wear characteristics of the tool.

The aforedescribed and other advantages of the present invention will become apparent by reference to the drawings, the description of the preferred embodiment and the claims.

BRIEF DESCRIPTION OF THE DRAWINGS

FIG. 11 illustrates the cutter position for the pilot;

FIGS. 12A–B illustrates the cutter position for the bi-center bit;

FIG. 16 represents a schematic view showing a shaped cutter between two PDC cutting assemblies;

FIG. 17 represents a schematic view showing engagement of shaped cutters to the borehole;

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENT

A. General Structure of the Bi-Center Bit

Figure 1:
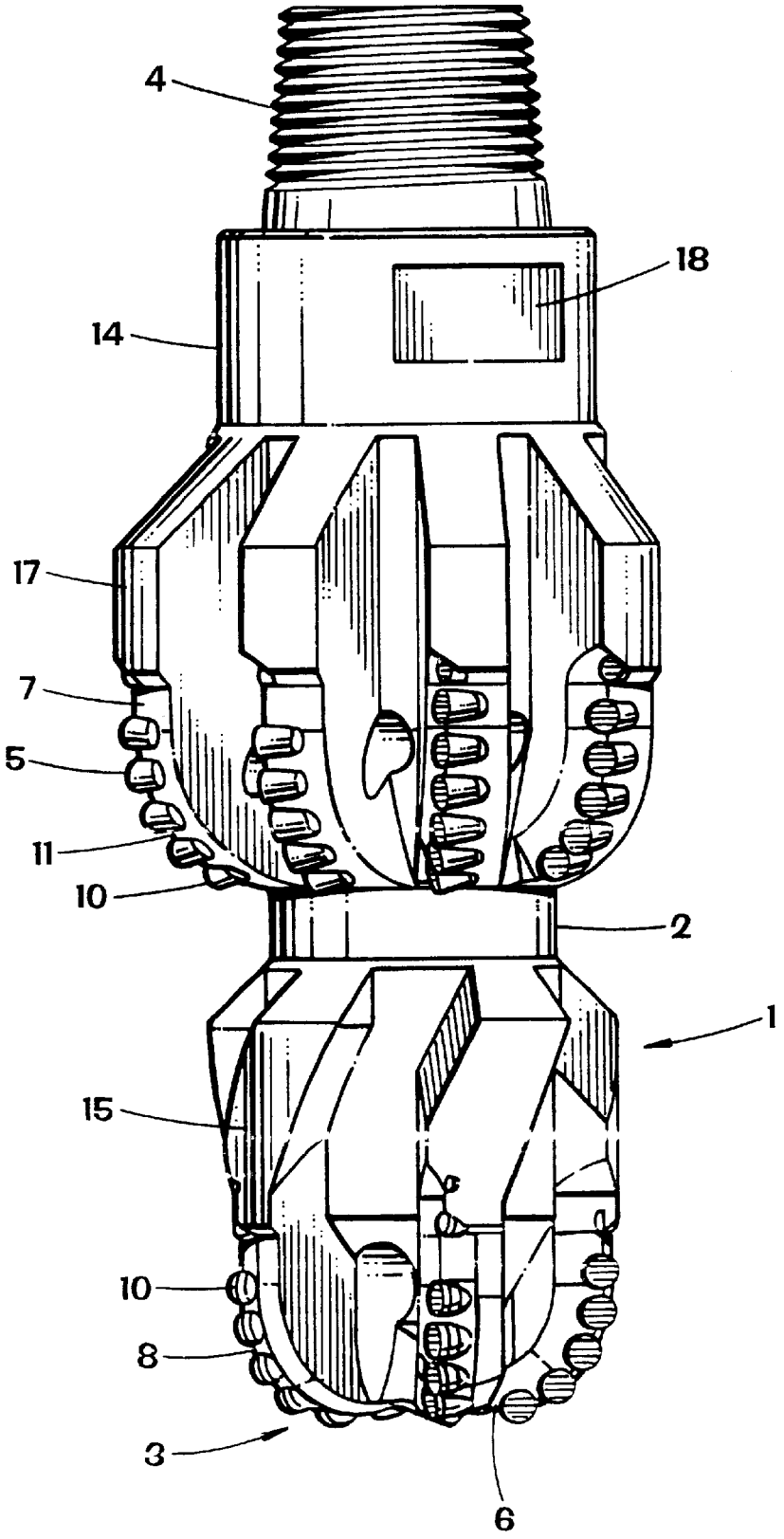
FIG. 1 is a side view of a bi-center drill bit of the present invention.
Figure 2:
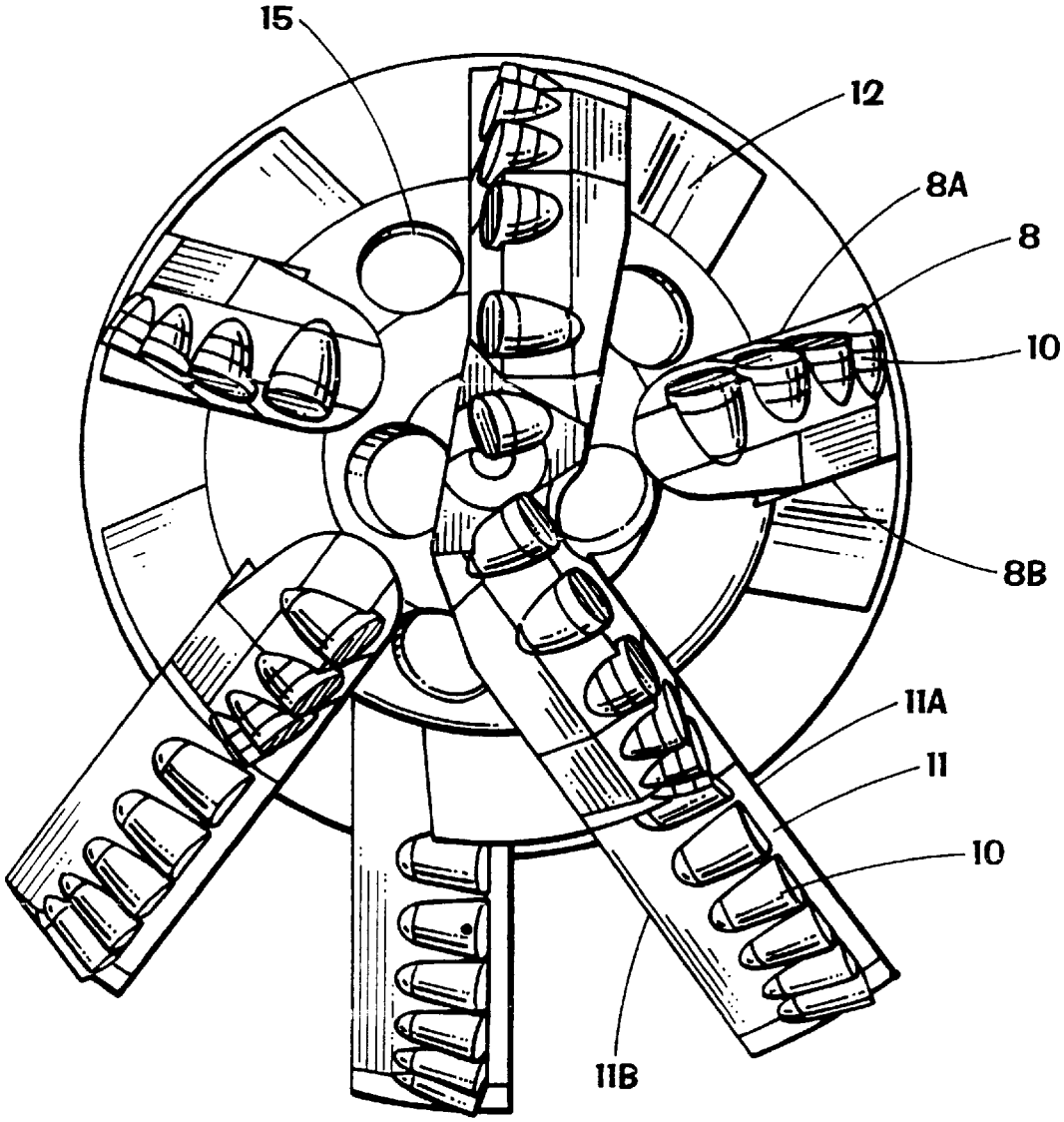
FIG. 2 is an end view of the working face of the drill bit in accordance with FIG. 1.

FIGS. 1 and 2 depict a bi-center drill bit of the general type in which the methodology of the manufacture of the present invention may be utilized. Bit body 2, manufactured from steel or another hard metal, has a threaded pin 4 at one end for connection in the drill string, and a pilot bit 3 defining an operating end face 6 at its opposite end. A reamer section 5 is integrally formed with the body 2 between the pin 4 and the pilot bit 3 and defines a second operating end face 7, as illustrated. The "operating end face" as used herein includes not only the axial end or axially facing portion shown in FIG. 2, but also contiguous areas extending up along the lower sides of the bit 1 and reamer 5.

Figure 4B:
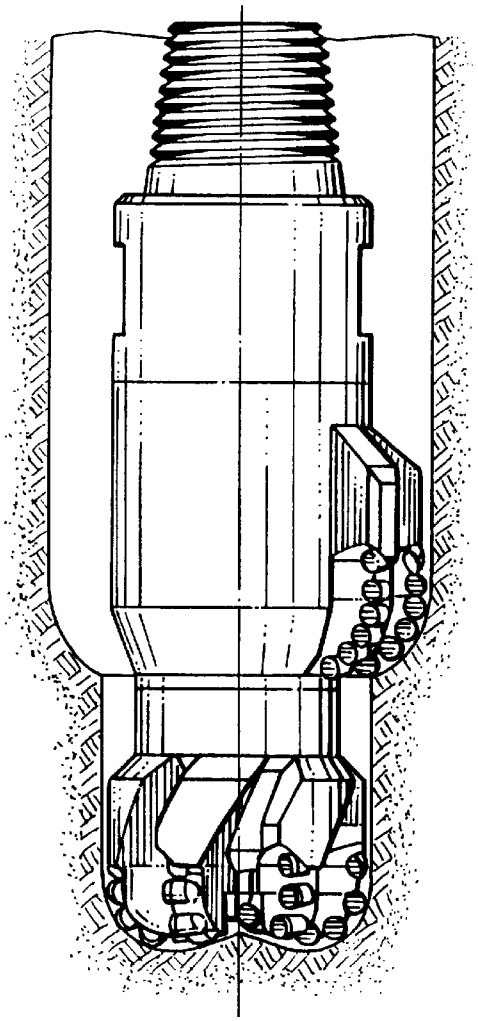
FIGS. 4A–B illustrate a side view of a bi-center bit as it may be situated in casing and in operation, respectively.
Figure 4A:
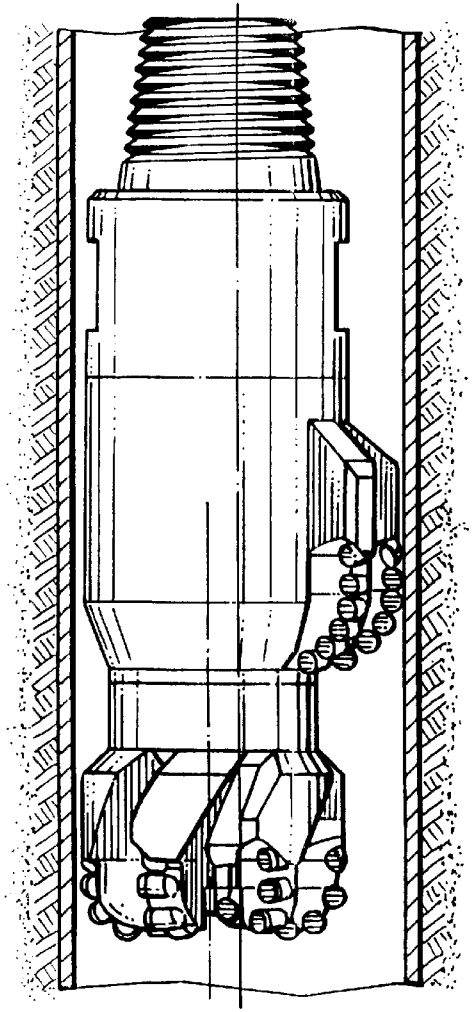

The operating end face 6 of bit 3 is transversed by a number of upsets in the form of ribs or blades 8 radiating from the lower central area of the bit 3 and extending across the underside and up along the lower side surfaces of said bit 3. Ribs 8 carry cutting members 10, as more fully described below. Just above the upper ends of rib 8, bit 3 defines a gauge or stabilizer section, including stabilizer ribs or kickers 12, each of which is continuous with a respective one of the cutter carrying rib 8. Ribs 8 contact the walls of the borehole that has been drilled by operating end face 6 to centralize and stabilize the tool 1 and to help control its vibration. (See FIG. 4).

Reamer section 5 includes two or more blades 11 which are eccentrically positioned above the pilot bit 3 in a manner best illustrated in FIG. 2. Blades 11 also carry cutting elements 10 as described below. Blades 11 radiate from the tool axis but are only positioned about a selected portion or quadrant of the tool when viewed in end cross section. In such a fashion, the tool 1 may be tripped into a hole marginally greater than the maximum diameter drawn through the reamer section 5, yet be able to cut a drill hole of substantially greater diameter than the pass-through diameter. See FIGS. 4A–B.

As illustrated in FIG. 1, cutting elements 10 are positioned about the operating end face 7 of the reamer section 5. Just above the upper ends of rib 11, reamer section 5 defines a gauge or stabilizer section, including stabilizer ribs or kickers 17, each of which is continuous with a respective one of the cutter carrying rib 11. Ribs 11 contact the walls of the borehole that has been drilled by operating end face 7 to further centralize and stabilize the tool 1 and to help control its vibration.

Intermediate stabilizer section defined by ribs 11 and pin 4 is a shank 14 having wrench flats 18 that may be engaged to make up and break out the tool 1 from the drill string (not illustrated). By reference again to FIG. 2, the underside of the bit body 2 has a number of circulation ports or nozzles 15 located near its centerline. Nozzles 15 communicate with the inset areas between ribs 8 and 11, which areas serve as fluid flow spaces in use.

Figure 6:
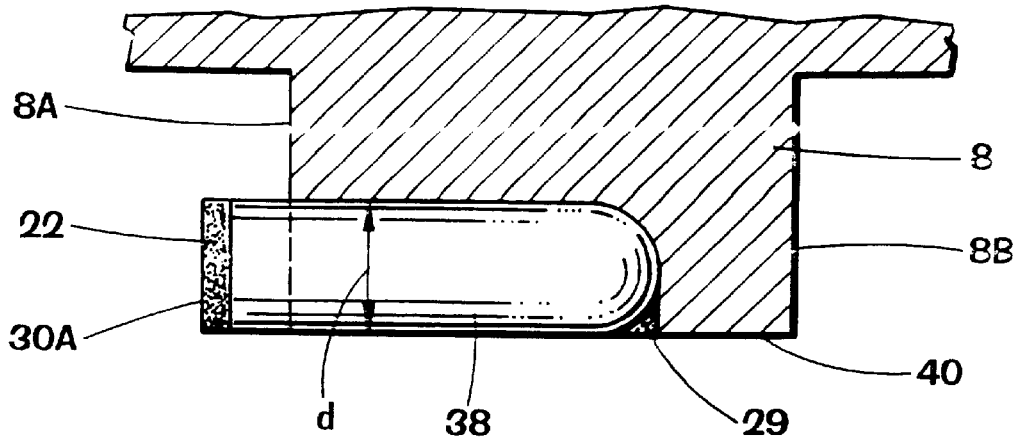
FIG. 6 illustrates a cutting structure brazed in place within a pocket milled into a rib of the drill bit in accordance with FIGS. 1 and 2.

With reference now to FIGS. 1 and 2, bit body 2 is intended to be rotated in the clockwise direction when viewed downwardly. Thus, each of the ribs 8 and 11 has a leading edge surface 8A and 11A and a trailing edge surface 8B and 11B, respectively. As shown in FIG. 6, each of the cutting members 10 is preferably comprised of a mounting body 20 comprised of sintered tungsten carbide or some other suitable material, and a layer 22 of polycrystalline diamond carried on the leading face of stud 38 and defining the cutting face 30A of the cutting member. The cutting members 10 are mounted in the respective ribs 8 and 11 so that their cutting faces are exposed through the leading edge surfaces 8A and 11, respectively. Ribs 8 and 11 are themselves preferably comprised of steel or some other hard metal. The tungsten carbide cutter body 38 is preferably brazed into a pocket 32 and includes within the pocket the excess braze material 29.

As a conventional PDC drill bit rotates, it tends to dig into the side of the borehole. This phenomenon reinforces itself on subsequent passes of the bit. Progressively, a non-uniformity is generated in the borehole wall, causing an impact on the gauge cutter in response to the wobble of the bit. Thus, because PDC bits tend to make the borehole slightly larger than the gauge diameter of the bit, often times causing the bit to wobble as it rotates, the stabilizer ribs 12 are otherwise exposed to high impact forces that can also damage the cutter assemblies such as the cutter assembly 134. To minimize this impact upon the cutter assemblies and the bit, the tungsten carbide button, being at the gauge diameter, protrudes laterally just ahead of the other cutting elements. The protrusion takes the impact instead of the cutter, and thus protects the cutter structure. Button 132 can be manufactured from tungsten carbide or any other hard metal material or it can be steel coated with another hard material. The present invention, in one embodiment, overcomes this problem by positioning the tungsten carbide insert on the stabilizer rib to take the impact that would have otherwise been inflicted on the cutter assembly.

Figure 5:
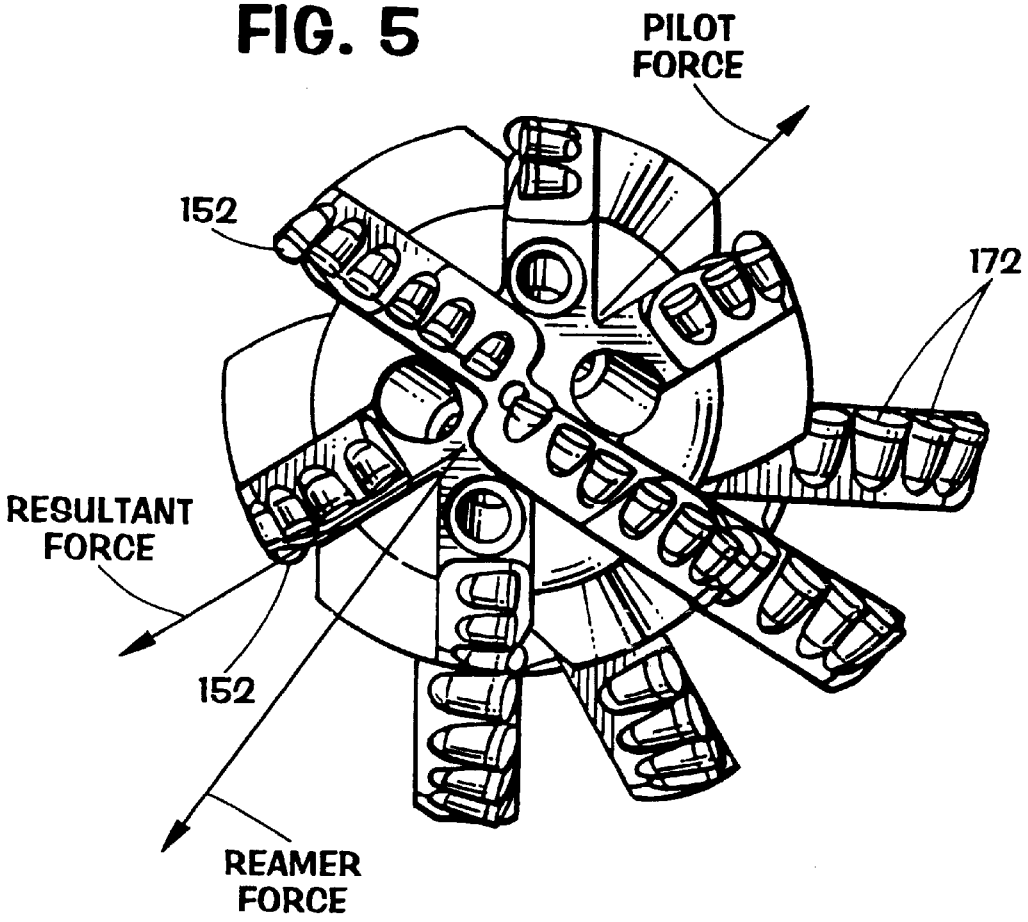
FIG. 5 is an end view of a bi-center bit constructed in accordance with the present invention illustrating the bi-center force imbalance.
Figure 15:
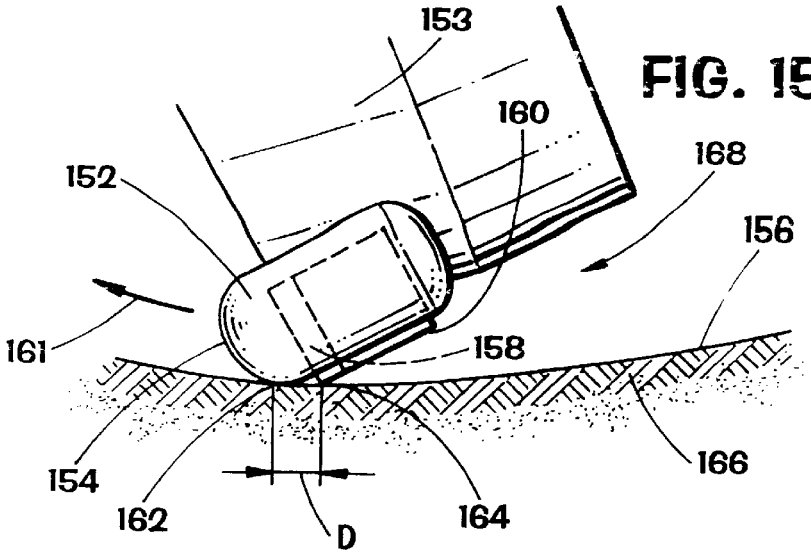
FIG. 15 is a schematic view of a hemispherically surfaced metallic insert engaging a borehole wall just prior to a PDC cutter element with respect to bit rotation direction.

FIGS. 5 and 15 illustrate the above concept in more detail. Referring to FIG. 15, tungsten carbide button 152 has a spherical, bullet-shaped sliding surface 154 to substantially slidingly engage borehole wall 156 rather than cut into formation 166 as a PDC cutter does. Like button 134, button 152 protrudes from blade or upset 153 to the gauge diameter of the bit in a presently preferred embodiment of the present invention. The borehole will typically be described as having a borehole gauge diameter, the ideal size borehole produced by due to the specific size of the bit, although the actual size of the borehole will often vary from the borehole gauge diameter depending on the formation hardness, drilling fluid flow, and the like. (See FIGS. 4A–B.) Thus, button 152 is preferably positioned to be at exactly the same diameter as the adjacent cutting face, in this case cutting face 158 of final PDC cutter assembly 160. Final PDC cutter assembly 160 is one of the plurality of PDC cutting assemblies 10 and is the cutter assembly for its respective upset spaced furthest from the end of bit cutting face 163 in the axial direction toward the threads. Each upset 8 or 11 would have a final PDC cutter assembly 160.

Button 152 extends by distance D just ahead of the adjacent cutting element in the direction of drilling bit rotation as indicated by rotation direction arrow 161 or, as stated hereinbefore, in the direction laterally just ahead of the other cutting elements such as PDC section 158 of PDC cutter assembly 160. Button 152 takes the impact, instead of PDC cutter assembly 160 thereby protecting PDC cutter assembly 160.

Distance D will vary depending on bit size but typically ranges from about one-eighth to about five-eighths of an inch with about three-eighths to one-half of an inch being typical. In terms of degrees around the general circumference of drill bit 150, the contact point 162 of button 152 to contact point 164 of PDC element 158 may typically range from about one degree to about fifteen degrees with about five or six degrees being most typical on a new bit. The points of contact, 162 and 164, will widen as the bit wears.

The sliding surface 154 of button 152 is substantially hemispherical in a preferred embodiment. Therefore, sliding surface 54 slides not only laterally or rotationally in the direction of drilling bit rotation 161 but also slides axially with respect to the drill string. Sliding surface 154 could have other shapes, with the criteria being that surface 154 substantially slides, rather than cuts into formation 166, especially laterally or rotationally in the direction of drill bit rotation 161.

Conveniently, the bullet-shaped design of a hard metal body, e.g. a tungsten carbide cutter body, is readily provided because the bullet-shaped body member 10, as discussed hereinbefore, may simply be reversed to provide a readily available button member 152 having the presently desired sliding surface 154. Button 152 is shown in FIGS. 1–2 on each upset 153 as discussed further hereinafter.

By maintaining substantially continuous sliding contact with borehole wall 156, button 152 not only protects the PDC cutting elements against impact with borehole irregularities but also performs the function of preventing or limiting bit whirl to thereby significantly stabilize drill bit 150 within borehole 168. Button 152 prevents final PDC cutter assembly 160 from cutting too deeply in a radially outwardly direction to thereby limit radial motion of bit 150 and thereby limiting whirling. Reduced or limited whirling results in less damage to the drill bit and also makes the bit much easier to directionally steer without "walking" in an undesired direction as may occur with other less stable drill bit designs.

Another embodiment of the present invention is shown in FIG. 16. Button 172 is preferably a bullet-shaped member, like button 152 discussed hereinbefore, that may also be used on cutting face 162 of the bit 150. In this embodiment, button 172 is used as a penetration limiter and is positioned between two neighboring cutters 178 and 179.

Button 172 is generally in-line with neighboring PDC cutting elements 178 and 179. Button 172 is preferably not placed in front of or behind the neighboring PDC cutting elements 178 and 179, with respect to the bit rotation direction, as in the prior art. Therefore, button 172 remains operational even if the bit becomes twisted or tilted in some manner that would lift such a prior art penetration limiter away from borehole wall 156 to become inoperative due to positioning in front of or behind neighboring PDC cutting elements 178 or 179.

When button 172 is used on drill bit 150 for this purpose, sliding surface 174 extends outwardly toward borehole wall 156 from upset or blade member 153 by an engagement distance "E". Engagement distance "F" of neighboring PDC cutter assembly is the distance by which neighboring PDC cutter assemblies 178, 179 extend in the direction of the borehole wall 156 or formation 166. The engagement distance "E" of sliding surface 174 is preferably less than the engagement distance "F" of neighboring PDC cutter assembly 178. Button 172 therefore acts as a penetration limiter that does not engage formation 166 until neighboring PDC cutter assembly 178 cuts too deeply the formation. Surface 174 is shaped to substantially slide along rather than cut into formation 166 and therefore limits the formation penetration of neighboring PDC cutting elements 178 and 179. In this manner, surface 174 promotes bit stability by restricting bit tilting or bit whirling. Thus, surface 174, which is preferably bullet shaped or hemispherical surface to slide rather than cut, does not normally engage borehole wall 156 except when necessary to provide increased stability. It will be noted that distance F may not always be the equal for neighboring PDC cutting assemblies 178, 179, but will preferably always be greater than "E".

B. Shaped Cutters

As shown in FIGS. 5 and 17, a shaped cutter 170 may be used in place of button 172 as a penetration limiter. Shaped cutter 170 has significant advantages over button 172 for use as a penetration limiter, as discussed hereinafter. Thus, distance "E" as applied to shaped cutter 170, is also the distance shaped cutter 170, or more specifically the body 176 of shaped cutter 170, extends toward borehole wall 156 or formation 166. Distance "F" will be greater than distance "E", when the bit is new. Shaped cutter 170 will not normally contact the borehole wall or wellbore when the bit is new. Shaped cutter 170 will contact borehole wall 156 when neighboring PDC cutting assemblies, such as 178 or 179, dig too deeply into formation 166. Shaped cutter 170 is disposed between and in-line with neighboring cutter assemblies 178, 179 in a manner described below.

Figure 14:
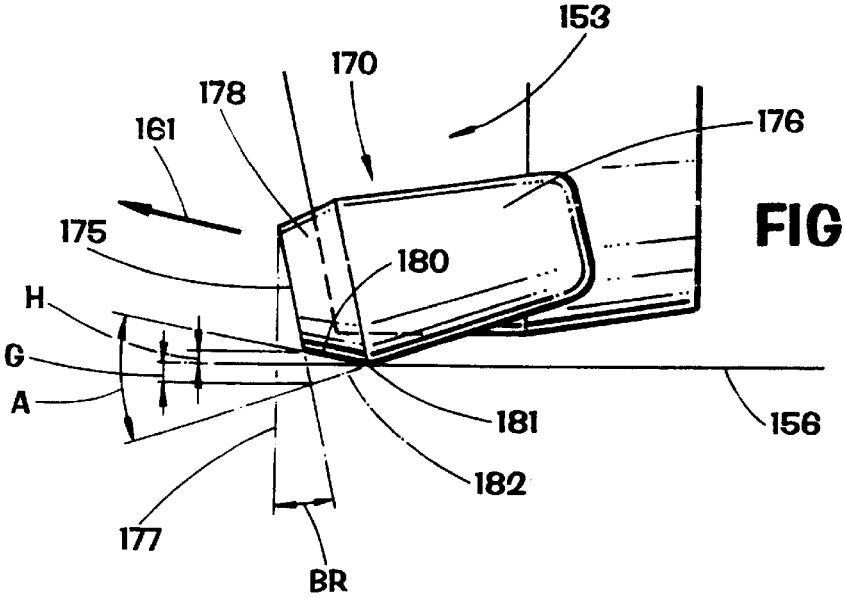
FIG. 14 is a schematic view showing engagement of shaped cutter to borehole where the bevel angle of the PDC element is greater than the backrake angle of cutter.

The basic features of shaped cutters 170 are perhaps best illustrated by reference to FIG. 14 wherein an enlarged shaped cutter 170 is schematically indicated. Shaped cutter 170 preferably includes a generally bullet shaped tungsten carbide body 176 to which is secured to a PDC cutting element 178. Shaped cutter 170 is mounted to blade 153 at a backrake angle BR, i.e., the angle of PDC face 175 with respect to the normal 177 to borehole wall 156 as shown in FIG. 14.

PDC portion 178 includes a frustoconical or beveled edge 180. The angle "A" of this beveled edge is determined by several bit design factors such as the cutter backrake. For the presently preferred embodiment, angle "A" of the beveled edge is greater than backrake angle BR. In this manner, it will be noted that body 176 rather than PDC portion 178 engages borehole wall 156, when engagement occurs as discussed above. For instance, PDC cutting portion 178 may be ground at a 30° angle while the backrake angle is 20°. Thus, there is a 10° angle between PDC portion 178 and borehole wall 156. In this manner, PDC portion 178 is substantially prevented, at least initially, from cutting into the formation like other PDC cutter assemblies such as neighboring PDC cutter element 182. Surface 181 extends radially outwardly toward the formation by a distance "H".

As stated hereinbefore, under normal drilling conditions and when bit 150 is new and relatively unworn, sliding surface 181 of shaped cutter does not normally engage borehole wall 156 at all. PDC cutter element 182 extends outwardly further than surface 181 by distance "G" for this purpose.

When drill bit 150 is new, sliding surface 181 engages borehole wall 156 only when adjacent PDC cutter assemblies, such as PDC cutter assembly 182 cuts too deeply into formation 166. However, if neighboring PDC cutter assembly 182 cuts too deeply into formation 162, then sliding surface 181 engages borehole wall 156 in a substantially slidingly rather than cutting manner to limit further penetration by PDC cutting assemblies such as PDC cutting assembly 182. In this way, penetration limiter shaped cutters 170 act to restrict tilting and whirling of bit 150. Shaped cutters 170 are disposed in-line with the other PDC cutter assemblies on bit as discussed previously so that they remain effective even if the bit twists or tilts as when, for instance, excessive loads are applied to the bit.

As bit 150 wears due to rotation, PDC cutter assembly 182 wears and surface 181 on shaped cutter 170 also wears. Wear on both items continues to the point where PDC portion 178 of shaped cutter 170 begins to engage borehole wall 156 substantially continuously. At this time, shaped cutter 170 essentially becomes just like the other PDC cutters. Thus, shaped cutter 170 acts as an ideal penetration limiter that "disappears" after the bit is worn.

As discussed hereinbefore, after the bit is worn, bit stabilization using penetration limiters is generally unnecessary because the worn surfaces themselves act to stabilize the bit. Additional surfaces, such as those of a prior art penetration limiter, increase the torque necessary to rotate the bit without providing any substantial additional bit stabilization. As well, on a worn bit, such prior art penetration limiters are inefficient because the contact of the penetration limiters is substantially continuous rather than limited to prevent excessive cutter penetration.

Although various shapes for shaped cutter 170 may potentially are possible, it is desired that (1) shaped cutter is profiled such that a substantially sliding surface engages the formation i.e. the surface substantially slides rather than cuts (2) the sliding surface does not normally engage the formation except when the bit forces are imbalanced, and (3) as the preferably carbide sliding surface wears away, along with the other PDC cutting assemblies, the PDC portion of the shaped cutter is eventually exposed to engage the formation substantially continuously as do the other PDC cutting assemblies i.e. the penetration limiter "disappears" and a cutter takes its place.

C. The Bi-Center Bit of the Present Invention

One embodiment of the bi-center bit of the present invention is developed as follows. First, cutting elements are positioned about the cutting face according to known techniques such as wear analysis, volume of cut, work rate (power) per cutter, etc. Once the radial position of the cutters is determined, a cutting force calculation is performed for both the pilot and the reamer. This cutting force is established by a combination of three equations which represent the normal force $F_N$, the bit torque $F_X$ and the vertical force $F_V$, where:

$$F_X = \frac{\mathrm{Sin}(\alpha - BR)}{1 - \mathrm{Sin}(\alpha - BR)} \cdot (C_3 \cdot RS \cdot d_w \cdot d_{CM}) + (C_4 \cdot F_N)$$

where $\alpha$ equals a rock constant, BR is given from the design of the tool, $C_3$ equals a constant, RS equals a rock constant, $d_W$ and $d_{CM}$ are given from the design of the tool and $C_4$ equals a constant. Combining the constants results in the relationship:

$$F_X = \frac{\mathrm{Sin}(\alpha - BR)}{1 - \mathrm{Sin}(\alpha - BR)} \cdot (K \cdot d_w \cdot d_{CM}) + C_4 F_N$$

The vertical force $F_V$ represents a component of the weight on the bit and is represented by the relationship:

$$F_V = F_N \cdot \mathrm{Cos}\ \beta$$

where $\beta$, the profile angle, is given from the design of the tool.

The normal force, $F_N$, is calculated from the following relationship:

$$F_N = \frac{\mathrm{Cos}(\alpha - BR)}{1 - \mathrm{Sin}(\alpha - BR)} \cdot (d_W \cdot B_F \cdot RS \cdot d_{CE} \cdot C_1) + (A_W \cdot RS \cdot C_2)$$

where $\alpha$ equals a rock constant, the variables BR, $d_W$, BF and $d_{CE}$ are given from the design of the tool, $C_1$, equals a constant, $A_W$ equals a wear flat area, which in the instance of a sharp tool is zero, RS equals a rock constant and $C_Z$ equals a constant. Combining terms, $$F_N = \frac{\mathrm{Cos}(\alpha - BR)}{1 - \mathrm{Sin}(\alpha - BR)} \cdot d_W \cdot K$$

Figure 13:
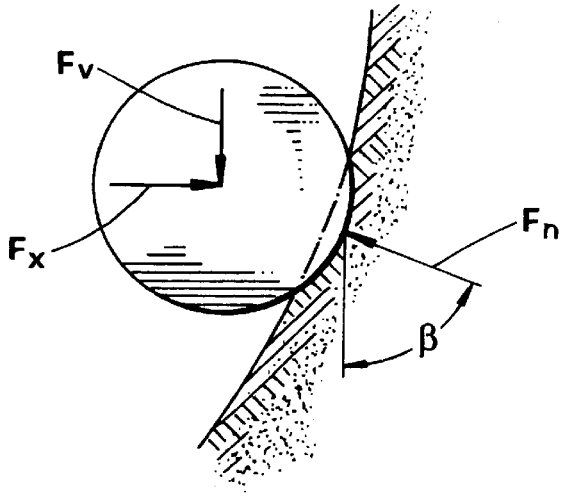
FIG. 13 is a schematic representation of each of the forces $F_V$, $F_N$ and $F_X$ as a given cutter.

The vector relationship of each of these forces is illustrated at FIG. 13.

The total cutting force for a bit or reamer represents the sum of cutting forces for each individual cutter. By changing the angular position of the cutters, the direction and magnitude of the resultant cutting force of the bi-center bit can be modified. While there is little flexibility in the angular position of the reamer, significant movement in the angular positions of the cutters on the pilot can be made. The angular positioning of the cutting elements is achieved using a polar coordinate grid system.

Once both the radial and angular position of the cutters has been established, an iterative calculation is performed to arrive at a desired magnitude and cutting force. In this step of the procedure, the cutting force is remeasured and the angular position of some of the cutters altered in an effort to achieve a resultant cutting force magnitude of the pilot as close as possible to the cutting force magnitude of the reamer. Once the cutting force for both the pilot and the reamer is known, the relative position of the pilot and reamer can now be designed. The reamer is positioned with respect to the pilot bit such that the direction of the pilot bit cutting force is opposite the cutting force of the reamer. (See FIG. 5.) This is accomplished via vector analysis. The net effect preferably results in a tool with a total force imbalance of no greater than 15%.

Alternatively, the cutters are positioned about the cutting surfaces of the pilot to purposively create a high force imbalance. The reamer is then positioned vis-a-vis the pilot to minimize the resultant force.

Additionally or alternatively, the positions of sliding elements, e.g. carbide buttons 152, may now be selected and positioned to maintain rotation about the centerline of the pilot. As illustrated in FIG. 5, the first position on which these elements 152 may be positioned is the leading blade 11 of the reamer section 5. The second position is one side of the pilot bit 3, in the direction of the cutting force opposite the reamer blades 11. These sliding elements, or penetration limiters, are concentrated about the upsets oriented about the line of resultant force. Fewer penetration limiters are positioned along the upsets flanking this resultant line.

Stabilization may also be accomplished by lowering the profile of the cutters or using smaller cutters on the leading blade of the reamer. In such a fashion, the bite taken by the first reamer blade is reduced, thereby reducing oscillation. Still alternatively, the angle of attack for the cutters may be reduced by canting the cutters back with respect to the mounting matrix.

EXAMPLE

Figure 3C:
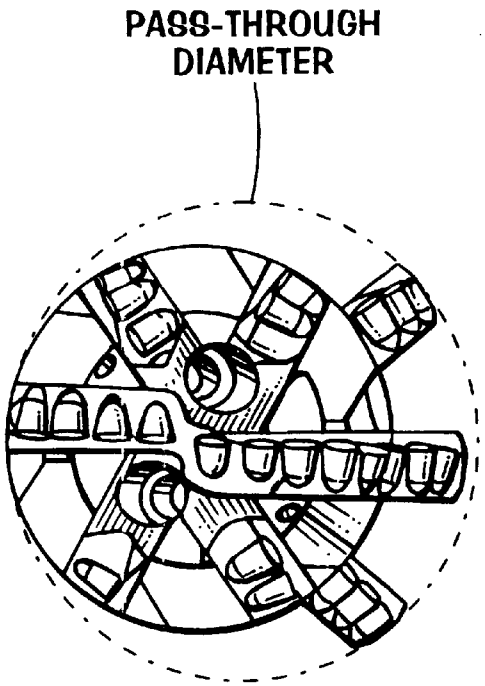
FIGS. 3A–C are end views of a bi-center bit as positioned in a borehole illustrating the pilot bit diameter, the drill hole diameter and pass through diameter, respectively.
Figure 3B:
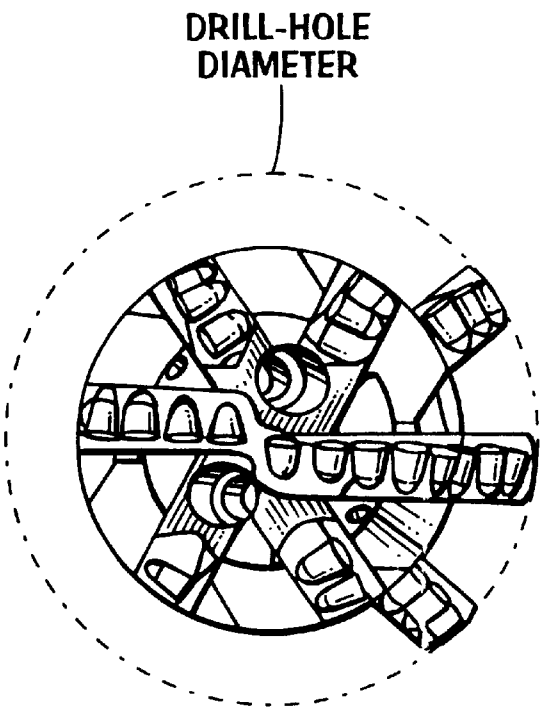
Figure 3A:
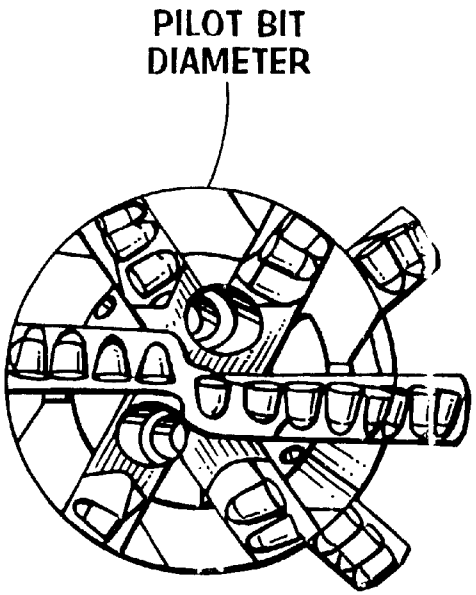

A request was made for a bi-center bit that would pass through a 8⅜" hole and drill a 9¼" hole. (See FIGS. 3A–C.) The reamer diameter was required to be small enough to allow the passage of follow-on tools. The general dimensions of the tool were calculated as follows and are illustrated at FIG. 23:

Reamer—4.63" radius

Drilling diameter—9.25"

Maximum Tool Diameter—7.69"

Figure 8:
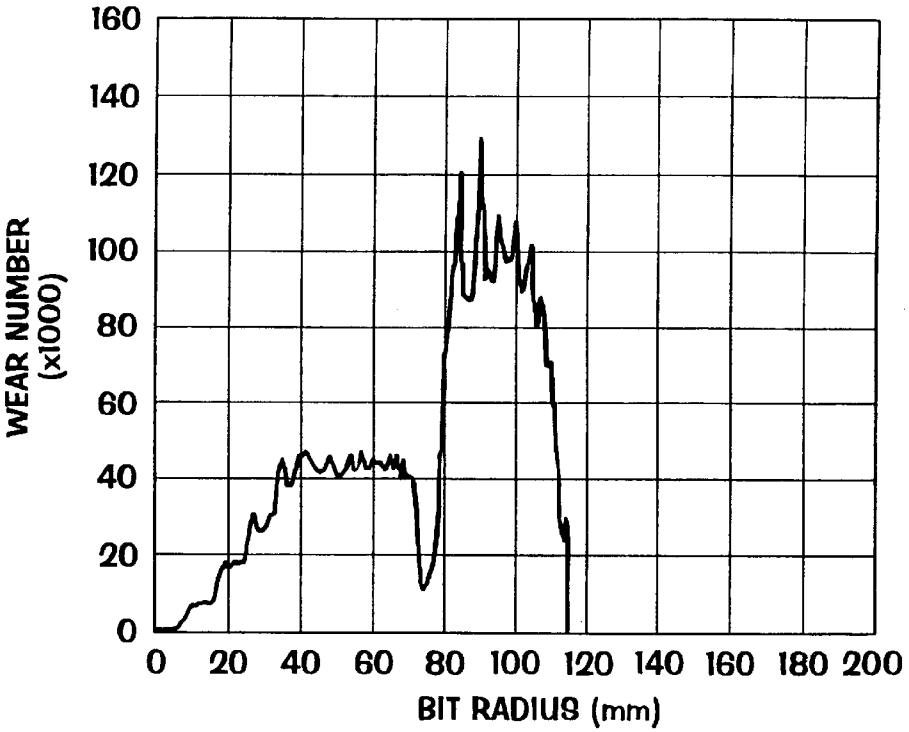
FIG. 8 diagrammatically illustrates a wear curve for the bi-center bit illustrated in FIG. 7.
Figure 7:
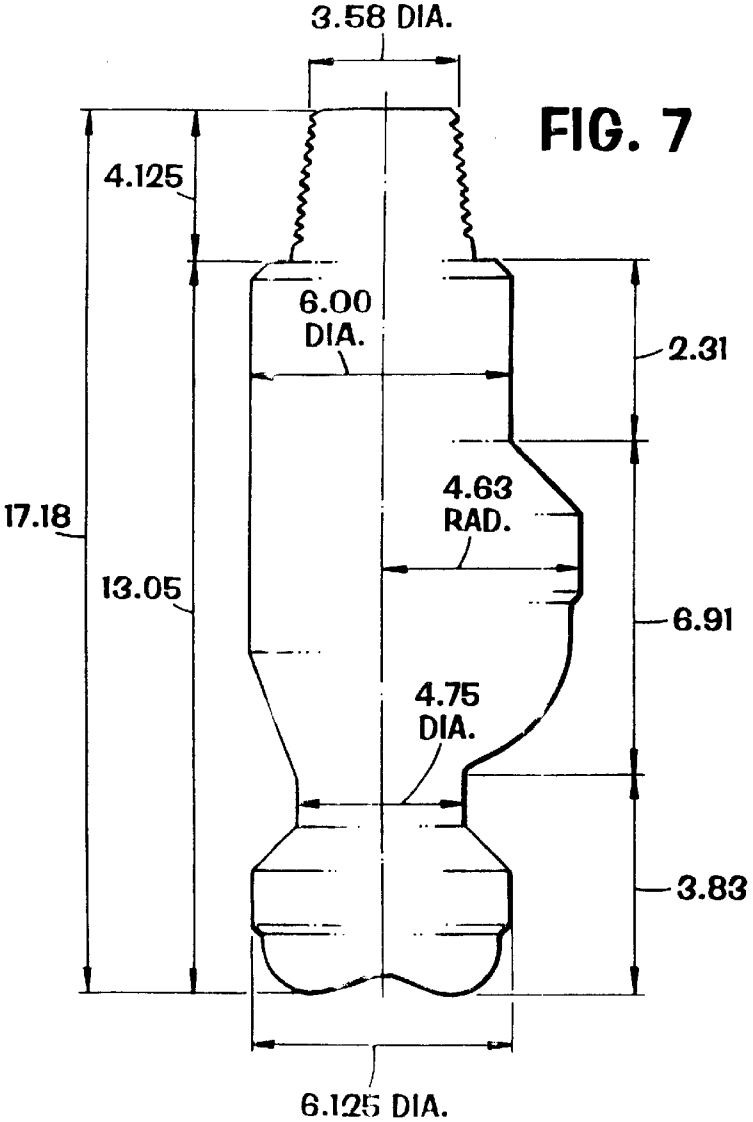
FIG. 7 illustrates a schematic outline view of an exemplary bi-center bit.
Figure 9:
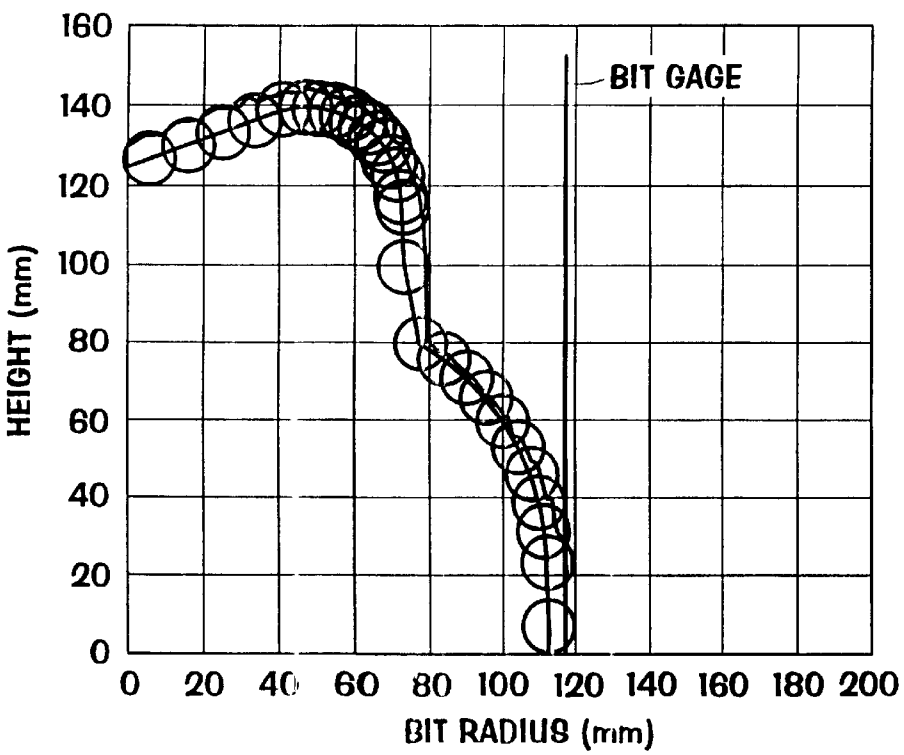
FIG. 9 diagrammatically illustrates the radial positions for the exemplary bi-center bit of FIG. 7.

The radial positioning of the cutters was then determined. In this example, the positioning was accomplished using a wear curve analysis as is well known to those skilled in the art. The wear curve for a bi-center bit of the subject dimensions is plotted at FIG. 8. This wear curve was plotted utilizing an optimum or "model" cutter profile as illustrated in FIG. 9. The wear graph illustrates the wear number from the center of the bit out to the gauge, where the higher the number, the faster that area of the bit will wear. The objective is to design a bit to have a uniform or constant wear number from the center to the gauge. The wear values themselves represent a dimensionless number and are only significant when composing the wear resistance of one area to another on the same bit.

The cutter profile represents an optimum distribution of cutters on both the pilot and reamer for radii 0–118 mm out to the bit gauge and their associated predicted wear patterns. The accuracy of this prediction has been confirmed by analyzing dull bits from a variety of bit types, cutter sizes and formations. This wear prediction is based on normal abrasive wear of PDC material. From this profile may be determined the volume of polycrystalline diamonds at radii values 0–118 mm. Solving for A in the equation:

$$A = \frac{r^2}{KV}$$

where A equals the wear number, K is a constant, V equals the volume of the polycrystalline diamond on the cutting face at bit radius, calculated at evenly spaced increments from bit radius equal 0 to bit radius equal 118 mm, the wear value is first plotted for the hypothetical model. This technique for the radial positioning is well known to those skilled in the art. Moreover, it is contemplated that other techniques for radial positioning may also be employed as referenced earlier.

Once the radial position of the cutting elements is determined, this is used to develop the angular positions of the cutters to obtain the desired force needed for the tool to maintain stability and long service life. This is accomplished by use of the relationships:

$$F_N = \frac{\mathrm{Cos}(\alpha - BR)}{1 - \mathrm{Sin}(\alpha - BR)} \cdot (d_W \cdot B_F \cdot RS \cdot d_{CE} \cdot C_1) + (A_W \cdot RS + C_2)$$

$$F_X = \frac{\mathrm{Sin}(\alpha - BR)}{1 - \mathrm{Sin}(\alpha - BR)} \cdot C_3 \cdot RS \cdot d_w \cdot d_{cm} + C_4 \cdot F_N$$

and, $$F_V = F_N \cdot \mathrm{Cos}\,\beta$$

where Fn equals the normal force needed to keep the PDC pressed into the formation at a given depth of cut, $\alpha$ equals a rock constant; BR is the cutter backrake angle; $d_W$ is the width of cut; $B_F$ equals the bit factor, experimentally determined, between 0.75 and 1.22; RS equals the rock strength; $d_{ce}$ is the depth of cut; $C_1$ is a dimensionless constant, experimentally determined, between 1,050 and 1,150; $A_W$ is the wear flat area, zero in a sharp bit, calculated from the geometry of the cutter; $C_2$ is a dimensionless constant, experimentally determined, between 2,100 and 2,200; $C_3$ is a dimensionless constant, experimentally determined, between 2,900 and 3,100; $d_{cm}$ equals the average depth of cut; $C_4$ is a dimensionless constant, experimentally determined, between 2,900 and 3,100; $F_X$ equals cutting force; and $\beta$ equals the profile angle.

The forces below are the vectorial sum of the individual cutter forces:

RS=18000 psi $A_W$=0

$B_F$=1

$C_1$=1.100

$\alpha$=34°

$C_2$=2.150

$C_3$=3.000

$C_4$=0.3

$d_{CE}$=0.05 in $d_W$, $\beta$, BR are different for each design and are different for each individual cutter.

Given the angular positions of the exemplary bi-center bit, the angular forces for the reamer were calculated as follows for this example:

| | |
|---|---|
| Percent Imbalance | 33.75% |
| Imbalance Force | 5116.65 lbs. @ 305.3° |
| Radial Imbalance Force | 1635.40 lbs. @ 253.3° |
| Circumferential Imbalance Force | 4308.32 lbs. @ 322.7° |
| Side Rake Imbalance Force | 259.50 lbs. @ 178.7° |
| Weight on Bit | 15160.39 lbs. |
| Bit Torque | 2198.44 ft.-lbs. |

The angular forces for the pilot bit were then calculated:

| | |
|---|---|
| Percent Imbalance | 14.51% |
| Imbalance Force | 1419.94 lbs. @ 288.7° |
| Radial Imbalance Force | 285.47 lbs. @ 317° |
| Circumferential Imbalance Force | 1176.16 lbs. @ 282.1° |
| Side Rake Imbalance Force | 11.56 lbs. @ 293.1° |
| Weight on Bit | 9784.36 lbs. |
| Bit Torque | 958.30 ft.-lbs. |

The collective force for the bi-center bit then followed:

| | |
|---|---|
| Percent Imbalance | 12.15% |
| Imbalance Force | 1842.29 lbs. @ 309.4° |
| Radial Imbalance Force | 1344.89 lbs. @ 228.8° |
| Circumferential Imbalance Force | 2097.12 lbs. @ 348.7° |
| Side Rake Imbalance Force | 232.23 lbs. @ 178.7° |
| Weight on Bit | 15,159.64 lbs. |
| Bit Torque | 2198.44 ft.-lbs. |

Figure 10:
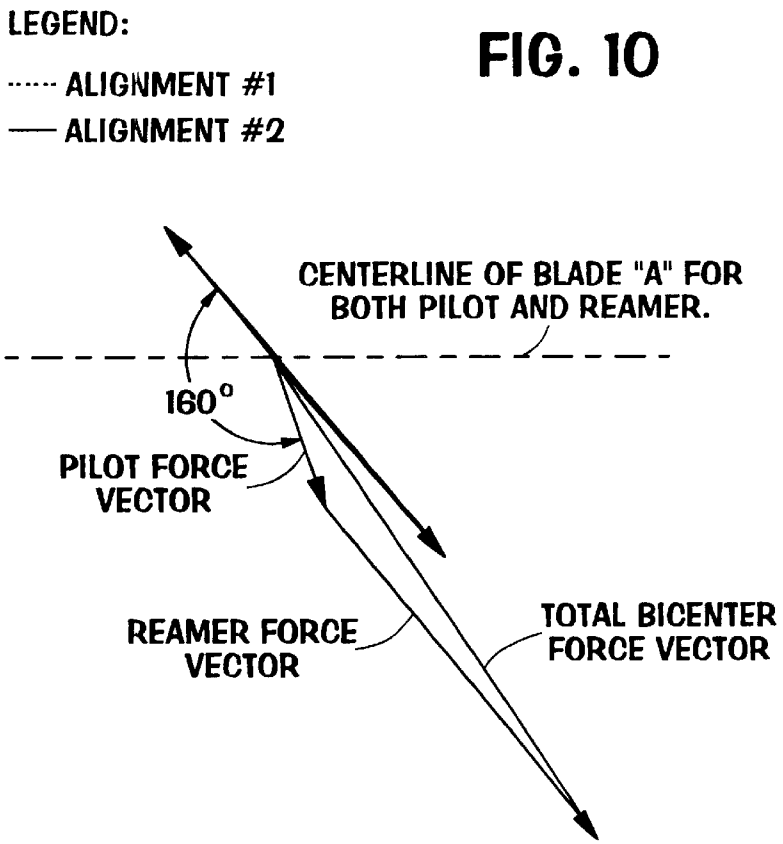
FIG. 10 diagrammatically illustrates the vectorial addition and positioning accomplished to obtain the overall force of the exemplary bi-center bit of FIG. 7.

The pilot and the reamer are then positioned relative to each other so as to reduce their vectorial sum. FIG. 10 illustrates the vectorial addition and positioning of the pilot bit and reamer to obtain the overall 12.15% present imbalance as identified above.

Given the above information, the cutter positions for the pilot were then calculated. For the given example, the positions of the shaped cutters with respect to (1) radius, (2) backrake, (3) side rake, (4) pref angle, (5) longitudinal position, (6) angular position is illustrated at FIG. 11, with the cutter positions for the complete bi-center bit illustrated at FIG. 12. In this example, the total imbalance was 12.15%.

Once the radial and angular positions of the shaped cutters were established, and the relative position of the reamer established vis-a-vis the pilot, sliding elements, e.g. shaped PDC elements or tungsten carbide buttons, were then added to the cutting surface of the tool to further reduce bit wear and improve bit stability in areas that are likely to have excessively high cutter penetration. This was accomplished by placing penetration limiters on the leading edge of the reamer at each available cutter site.

Though not employed in this example, standard cutters may have alternately been employed on the reamer with a reduced angle of attack, e.g. canted or lowered in profile. Still alternatively or additionally, shaped cutters could have been placed on the pilot upsets along the line of the resultant force. Each of these alternate methods, in use independently or in concert with the afore-referenced techniques, serve to stabilize the bi-center bit.

The completed bi-center bit as designed and assembled in accordance with the methodology of the present invention with the starting parameters of the subject example is illustrated at FIG. 13.

Referring to FIG. 13, the heretofore discussed hard metal inserts, tungsten carbide buttons 152, extend to borehole gauge and were used on each respective blade or upset 153. In the embodiment illustrated in FIGS. 13 and 14, buttons 152 were used on all blades 153. This arrangement however, is not typical and will vary with the force imbalance as identified above. Generally, it is desired that more than one carbide button 152 be used to stabilize the bit within the borehole.

In operation of bit 150, ports 190 allow for drilling fluid circulation through recesses 192 between blades 153. Bit 150 is rotated in bit rotation direction 161. PDC cutting elements 18 and other elements as discussed above cut into the formation. Bit whirl is significantly reduced due to both the action of buttons 152 and shaped cutters 170. Buttons 152 tend to have little effect on bit tilting instability problems caused, for instance, by too much weight on the bit. However, shaped cutters 170 act to prevent instabilities for bit tilting as well as bit whirling.

Thus, the bit as designed in accordance with the present invention is ideal for directional drilling purposes. The bi-center bit of the present invention also tends to wear significantly longer than a standard bit. As well, due to the higher level of bit stability, other related drilling components tend to last longer thus providing overall cost savings by use of the present stabilized bit.

In some applications it has been discovered that the wear characteristics of a bi-center bit constructed in a manner consistent with the methodology described above does not match that predicted. In this connection, in some instances maximum wear on the cutting elements were exhibited to exist at both the leading and trailing edges of the reamer and at a direction some 180 degrees opposite the centerline defined by these two wear points. Moreover, some bi-center bits cut an undersized borehole when compared to the rotated diameter of the reamer.

This undersized borehole is the result of forces which push the pilot bit generally in a direction opposite the reamer. In undersized borehole is detrimental to bi-center performance since the primary purpose of a bi-center bit is to produce a hole which is larger than that which is possible by the use of a drill bit under similar circumstances. Furthermore, the undersized borehole is also detrimental to the bi-center bit itself by creating three focal points at which wear on the bit is maximized.

Figure 18:
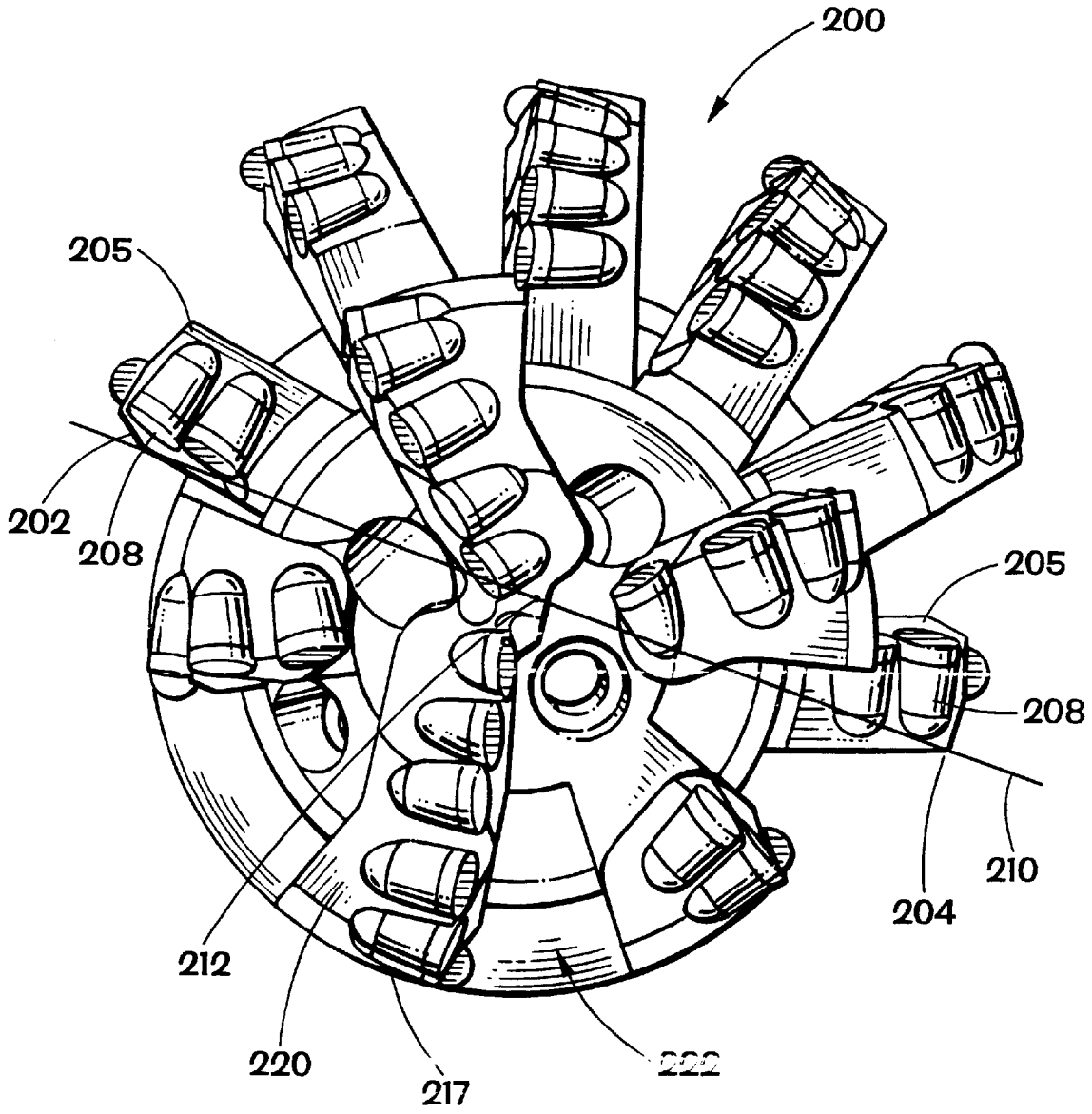
FIG. 18 illustrates a bottom, detail view of another embodiment of a bi-center bit of the present invention.

To address these empirical observations, another embodiment of the invention contemplates the placement of a rib some one hundred and seventy to one hundred and ninety degrees opposite the midpoint defined between the leading and trailing edges of the reamer. By reference to FIG. 18, a bi-center bit is provided with a reamer 200 describing a leading 202 and a trailing edge 204. The ribs 205 defining both leading edge 202 and trailing edge 204 are provided with shaped cutters 208, in a manner discussed above.

Leading edge 202 and trailing edge describe a chord 210 the midpoint of which may be designated 212. A line drawn normal to chord 210 through point 212 in the plane defined by the cutting face and opposite the reamer 200 will describe a point 217. This point 217 describes the ideal and preferred location for the placement of a cutting rib 220 on the pilot bit 222. Consistent with the objective of this embodiment, it has been found that acceptable performance of the bi-center bit may be achieved if the pilot bit includes an upset provided with shaped cutters and/or a gauge pad within ten degrees on either side of point 217.

Figure 19:
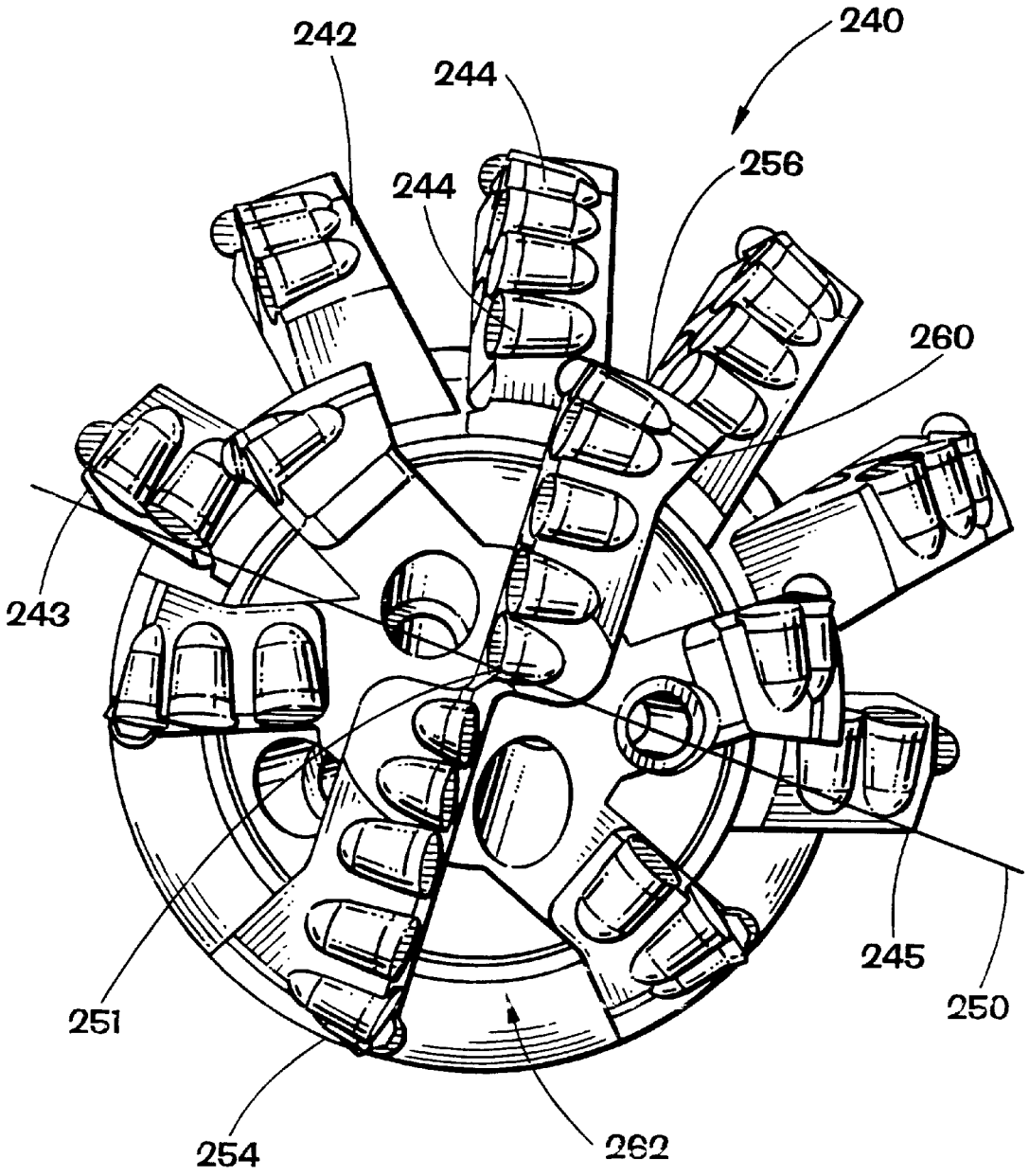
FIG. 19 illustrates a bottom, detail view of yet another embodiment of a bi-center bit.

In yet a further embodiment, it has been found that performance of the bi-center bit may be additionally enhanced if the pilot bit is provided with a second cutting rib opposite the first cutting rib as oriented opposite the reamer. This embodiment may be seen by reference to FIG. 19, in which is illustrated a reamer 240 provided with a plurality of cutting ribs 242 and cutting elements 244, where said reamer 240 defines a leading edge 243 and a trailing edge 245. Leading edge 243 and trailing edge 245 described a chord 250 defining a midpoint 251.

A line taken normal to chord 250 in a plane parallel to the plane described by the bit face defines a point along two points of the periphery of the pilot bit 262, designated 254 and 256. It has been found that placement of a cutting rib 260 on the pilot bit 262 within ten degrees of both points 254 and 256 will still further enhance the performance of the bit by reducing the tendency to create an undersized hole.

The foregoing disclosure and description of the invention is illustrative and explanatory thereof, and it will appreciated by those skilled in the art, that various changes in the size, shape and materials as well as in the details of the illustrated construction or combinations of features of the various bit or coring elements may be made without departing from the spirit of the invention.

What is claimed is:

1. A bi-center bit having enhanced stability comprising:

a body defining a proximal end adapted for connection to a drill string and a distal end, where said distal end defines a pilot bit and an intermediate reamer section, where both the pilot bit and the reamer section possess one or more cutting surfaces, said reamer section defining a leading cutting surface and one or more trailing surfaces;

a plurality of cutter assemblies being radially disposed about the cutting surfaces of the pilot bit and the reamer section; and said leading and trailing surfaces of said reamer section defining a midpoint therebetween where at least one first cutting surface on said pilot bit is disposed within ten degrees of a line taken through said midpoint and normal to a line connecting said leading and trailing surfaces and opposite said reamer section.

2. The bi-center bit of claim 1 where further the shaped cutter assemblies are positioned about the leading surface of the reamer along the line defined by the resultant force of the pilot bit and the reamer section so as to further minimize the force imbalance.

3. The bi-center bit of claim 2 where each of the shaped cutter assemblies includes a PDC portion and a body portion.

4. The bi-center bit of claim 3 where said shaped cutter assemblies are comprised of polycrystalline diamond compacts brazed to a tungsten carbide support.

5. The bi-center bit of claim 3 wherein the shaped cutter assemblies include a generally bullet shaped tungsten carbide body which is secured to a PDC cutter element.

6. The bi-center bit of claim 3 where said PDC portion includes a frustroconical or beveled edge defining a backrake angle A, where said angle A is greater than the backrake angle BR.

7. The bi-center bit of claim 6 further including a second cutting surface on said pilot bit within 170 to 190 degrees of a centerline described by said first cutting surface.

8. The bi-center bit of claim 2 where said cutter assemblies are radially disposed about said reamer section and said pilot bit in accordance with a wear analysis projection of the bit.

9. The bi-center bit of claim 1 where said cutter assemblies are angularly situated about the cutting surfaces of the pilot and the reamer section to minimize the resultant of the vectorial sum of the forces normal to the bit $F_N$, the vertical forces acting on the bit $F_V$ and the bit torque $F_X$.

10. The bi-center bit of claim 1 further including penetration limiters positioned about the pilot bit on cutting surfaces formed about a line defined by the resultant force of the pilot and the reamer section.

11. The bi-center bit of claim 10 where said penetration limiters comprise a reverse bullet shaped tungsten element.

12. The bi-center line of claim 10 where said penetration limiters comprise a shaped cutter.

13. The bi-center bit of claim 1 further including penetration limiters positioned about the pilot bit or cutting surfaces formed about a line defined 170 to 190 degrees from the midpoint.

14. The bi-center bit of claim 1 wherein said shaped cutters are mounted to a cutting surface at a selected backrake angle BR.

15. A method for enhancing the stability of a drill bit assembly when drilling in a borehole through a formation, where said bit comprises a body having a proximal end which is operatively engageable to a drill string and a distal end which defines a pilot bit, where further one side of said body intermediate the distal and the proximal ends defines a reamer section, where both said pilot and reamer sections define a series of cutting surfaces, said method comprising the steps of:

radially mounting a plurality of cutter assemblies about the cutting surfaces of the pilot bit and reamer section, where the cutting surfaces on said reamer section define a leading and a trailing surface; and positioning the cutting surface of said pilot bit within ten degrees of a line taken normal to a line connecting said leading and trailing surfaces of and opposite to said reamer section.

16. The method of claim 15 further including the step of positioning shaped cutters along the leading cutting surface of said reamer section.

17. The method of clam 16 where said reamer includes a leading upset and follow-on upsets, where the cutter assemblies disposed on said leading upset are provided with a reduced angle of attack vis-a-vis the formation when compared to other cutter assemblies on said bit.

18. The method of claim 15 where said shaped cutters comprise shaped polycrystalline diamond compacts.

19. The method of claim 15 where shaped cutter assemblies are disposed along upsets arranged along or proximate to the resultant force line of the assembly.

20. The method of claim 15 further including the step of positioning said reamer section relative to the pilot to minimize the cutting force imbalance between the pilot and the reamer section.

21. The method of claim 15 further including the step of providing the cutting surface on said pilot bit within 170 to 190 degrees of said leading surface on said pilot bit.

* * * * *